US005819846A

United States Patent [19]

Bolt, Jr.

[11] Patent Number: 5,819,846

[45] Date of Patent: Oct. 13, 1998

[54] BRIDGE PLUG

[76] Inventor: Donald B. Bolt, Jr., 3720 E. 99th Pl., Tulsa, Okla. 74137

[21] Appl. No.: 724,282

[22] Filed: Oct. 1, 1996

[51] Int. Cl.[6] ..... E21B 23/00

[52] U.S. Cl. ..... 166/123; 166/135

[58] Field of Search ..... 166/118, 123, 166/134, 135, 181, 192

[56] References Cited

U.S. PATENT DOCUMENTS

| | | | |
|---|---|---|---|
| 2,906,346 | 9/1959 | Johnston | 166/214 |
| 3,082,824 | 3/1963 | Taylor et al. | 166/123 X |
| 3,097,697 | 7/1963 | States | 166/138 |
| 3,142,338 | 7/1964 | Brown | 166/120 |
| 3,198,254 | 8/1965 | Wise et al. | 166/48 |
| 3,298,437 | 1/1967 | Conrad | 166/123 X |
| 3,306,362 | 2/1967 | Urbanosky | 166/123 X |
| 3,344,861 | 10/1967 | Claycomb | 166/123 X |
| 3,422,897 | 1/1969 | Conrad | 166/123 X |
| 3,422,899 | 1/1969 | Brown | 166/129 |
| 3,506,067 | 4/1970 | Lebourg | 166/123 X |
| 3,602,305 | 8/1971 | Kisling, III | 166/134 |
| 3,687,196 | 8/1972 | Mullins | 166/217 |
| 4,573,537 | 3/1986 | Hirasuna et al. | 166/387 |
| 4,708,202 | 11/1987 | Sukup et al. | 166/123 X |

*Primary Examiner*—William P. Neuder
*Attorney, Agent, or Firm*—Robert E. Massa

[57] ABSTRACT

A bridge plug positionable within a well casing and adaptable for sealing the casing comprises a flexible sealing element positionable to be driven into a sealing position by the force of a compressing mechanism which includes a first component held stationarily below the sealing element and a second component positioned movably above the sealing element. Coincidentally with the compressive movement of the sealing element, an upper and a lower member of the compressing mechanism provide means for securing the bridge plug in position, fracture, with the fractured portions of each driven securely against the inner wall of the casing. Cooperative portions of the bridge plug have components which interlock in a manner to guide a slip radially outwardly toward the inner wall of the casing for equal distribution against the casing wall upon fracturing. The even distribution of the slip portions provide for equal distribution of the lateral force upon the sealing element upon being compressed.

31 Claims, 4 Drawing Sheets

BRIDGE PLUG

FIELD OF THE INVENTION

My invention relates to a bridge plug which provides a seal for a well casing. More particularly, my invention relates to a bridge plug for a well casing which incorporates a flexible sealing element which responds to a longitudinal force in a manner in which the sealing movement is evenly distributed laterally against the inner wall of the well casing. Still more particularly, my invention relates to a bridge plug in which a slip component is directed to fracture into segments of substantially equal size which are distributed uniformly laterally around the well casing, thereupon providing a more secure circumferential loading of the bridge plug upon the casing wall.

BACKGROUND OF THE INVENTION

A bridge plug is a tool which is used to plug, or seal, a well, such as an oil, gas, water, or similar type well, in order to prevent escape of fluids from the well.

A most convenient form of bridge plug is a type which includes a flexible sealing element which is set into sealing engagement with the wall of the well casing after positioning of the bridge plug at the chosen depth in the casing.

In order to be anchored at the chosen position within the well and made to form a tight seal, the seal element is compressed and held in secure position by the action of the bridge plug components.

The bridge plug includes several components which cooperate to provide the proper setting action upon the seal element. One component positioned below the sealing element provides a means for developing an upwardly directed resistance force and another component positioned above the sealing element provides a downwardly directed force, while other components cooperate to provide means for securing the sealing element at the chosen depth.

Generally, the bridge plug is held in a sealing engagement by the cooperation with the sealing element of components known as a cone member and a slip.

The cone member initially engages an internal conical surface of the slip. During the time that downwardly directed compressive force is being applied to the bridge plug, the cone member transmits this force to the slip, causing the slip to fracture into segments, which segments are then forced to move radially when the force reaches an anticipated value.

The slip includes a series of sharp gripping members encircling the body of the slip. The continuing fracture force of the cone member upon the slip forces the gripping elements of each fractured portion of the slip to engage the inner wall of the casing.

A component of the bridge generally referred to as a slip divider presses upon an end of the slip opposite the cone member and transmits the fracturing force to the cone member and slip from a source of energy located above the bridge plug.

I have described the basic operative features of a bridge plug in positioning and maintaining in position a sealing element and slip.

Initially, the bridge plug is positioned upon the lower end of a mandrel attached to the lower end of a small component known as a shearing device or parting stud. The shearing device is attached to a rod inserted a suitable distance down the well casing. The rod is held in stationary position by means from above the casing.

A movable cylindrical member encircles the rod and is positioned down the casing. The cylindrical member transmits force from above the ground urging the cylindrical member downwardly against a cap secured to the mandrel, and at the same time pressing against the slip divider.

The shearing, or parting stud, is designed with a reduced radius essentially between the ends of the shearing device. The radial portion of the shearing device is designed to have a predetermined force resistant value at which the shearing device will fail as this value is exceeded. This value is the fracture value of the shearing device, and above this value the bridge plug separates from the rod member, almost simultaneously causing the slips to fracture.

I have described above the basic action of a bridge plug in securing a sealing element and slip in a casing.

The same manner of operation is provided by another slip divider, slip, and cone member placed below the sealing element but oriented upwardly toward the sealing element. The lower slip divider rests upon a guide member attached to the lower end of the mandrel.

As the fracturing force is being applied to the cylindrical member, with the bridge plug initially held in stationary position, the fracturing force initiates the following actions:

1. The shearing device fails as the calculated shearing force is reached.
2. The upper and lower slips fracture.
3. The sealing element is compressed into a sealing engagement with the casing wall and secure sealing position around the mandrel.
4. The fractured slip portions are forced into engagement with the casing wall to be held in such position by the gripping members of the upper and lower slip members.

Thus, with the bridge plug held in a secure sealing position, both the rod member and cylindrical member may be withdrawn from the well.

The prior art I have found during my search includes the following material:

| | | |
|---|---|---|
| U.S. Pat. No. 2,906,346 | J. L. Johnston | Sept. 29, 1959 |
| U.S. Pat. No. 3,097,697 | W. H. States | July 16, 1963 |
| U.S. Pat. No. 3,142,338 | C. C. Brown | July 28, 1964 |
| U.S. Pat. No. 3,198,254 | E. H. Wise et al | Aug. 3, 1965 |
| U.S. Pat. No. 3,422,899 | C. C. Brown | Jan. 21, 1969 |
| U.S. Pat. No. 3,687,196 | Mullins | Aug. 29, 1972 |
| U.S. Pat. No. 4,573,537 | Hirasuna et al | Mar. 4, 1986 |

U.S. Pat. No. 2,906,346 to Johnston describes a slip actuating device which comprises a plurality of slips positioned between upper and lower actuating components which are threadedly connected to place the slip members in proper position. The actuating components are prevented from becoming unthreaded by action of the upward flow of well fluid upon a plurality of vanes at the lower end of the device. The mandrel and attached slips are unthreaded by rotation of the device from above the well string, and a heavy coil spring beneath the slips forces the slips upwardly to be placed into engagement with the well bore by taper components engaging the slips.

U.S. Pat. No. 3,097,697 to W. H. States describes a liner device for an oil well which comprises a system for placing wickered slips into biting positions within the casing in order to be able to attach various tools to the lower end of the hanging device. The hanging device includes a spring assembly comprising a series of circumferentially spaced longitudinal flexible fingers held initially parallel to the surface of the inner tubular body by a series of circumferentially spaced bowed springs and attached rings.

The bowed springs act to retain the hanging device in position. Movement of the spring assembly releases the flexible fingers while the bowed springs retain the hanging device in position. The flexible fingers cause release from a secure position of attached lugs and permits downward movement of the assembly, thus permitting action of tapered cones against the wickered slips causing the slip segments to bite into the casing wall and permitting sealing engagement of the resilient packer element with the casing wall.

U.S. Pat. No. 3,142,338 to C. C. Brown describes a well packer assembly which includes a means for locking the assembly against movement in either direction within the well bore, and having means for releasing the locking components to permit removal of the complete assembly from the well bore when removal is desired. The packer assembly is mounted upon a mandrel with upper and lower sections threadedly connected. The packer assembly includes an upper packer, expander, and a plurality of radially positioned slip components along with a lower packer, expander, and plurality of radially positioned slip components. In each section of packer assembly, a radially directed shear pin retains the slip components in a raised position by being held in attachment to an adjacent expander component until proper lengthwise pressure is attained. Removal of the entire apparatus is effected by rotating the upper portion of the lowering pipe to cause a mechanical releasing of the slips.

U.S. Pat. No. 3,198,254 to E. H. Wise et al describes a well packer apparatus which includes a pair of parallel mandrels. A first mandrel passes slidably thru an upper connector, but a second mandrel passes the upper connector, but is threadedly connected to the upper connector. After passing thru the upper connector, the first mandrel is secured to a bottom connector by a retainer ring, Downward force upon the second mandrel or body member causes expansion of slips against the well casing, When the unit is to be released, a trip ball is lowered down the second body member with the eventual release of energy upon the second body member. Fluid is then allowed to pass thru the first body member and second body member.

U.S. Pat. No. 3,422,899 to C. C. Brown describes a well packer having a tubular support, a packer assembly releasably connected thereto including a holddown assembly, anchoring assembly, and release means. The holddown assembly includes gripping buttons which can be forced radially outwardly into gripping position by the force of well fluids. The packing assembly includes a packing sleeve, a packing element, and means for releasably connecting the packing assembly to the tubular support.

U.S. Pat. No. 3,687,196 to Mullins describes a slip structure which comprises an annular ring having a plurality of longitudinally holes which provide weakened sections of the slip to facilitate breakage of the slip when lateral pressure is placed upon the slip by an expander cone during setting of the unit.

U.S. Pat. No. 4,573,537 to Hirasuna et al describes a well casing packing which includes a non-elastomeric seal element which is deformed by application of a pull-up force on the mandrel. This causes the seal element to expand outwardly against the sides of the casing. Preferably, the seal element is formed of a metal, such as brass or nickel which are capable of withstanding high temperatures as sometimes encountered in certain operations. A slip system is included in which wedge members drive slips radially outward to engage the casing.

SUMMARY OF THE INVENTION

The primary object of my invention is to provide a bridge plug for a well casing which is efficient, easy to operate, and easy to manufacture.

Another object of my invention is to provide a bridge plug for a well casing which is reliable in operation, and operates reliably at the chosen force placed upon its system, and will transmit sufficient force to direct slip segments Predictably in a secure position against the well casing.

Still another object of my invention is to provide a bridge plug for a well casing which is operable under a variety of well conditions.

Still another object of my invention is to provide a bridge plug for a well casing which will respond to mechanical or hydraulic force placed upon the system, and which may be placed in position and operated by fluid or electrical setting tools.

Other objects and advantages of my invention will become apparent as I describe the advantages which I have found with my invention.

With my long experience in the manufacture and use of many forms of drilling devices and well components, I have seen many tools and pieces of apparatus which had appeared to be in need of improvement, either in structure, material, or operation.

I have paid particular notice over the years to the manner in which various types of bridge plugs with their inclusive slip devices were designed and operated. Quite often, I found that many types of bridge plugs failed to perform their basic function; usually, this failure was a result of slip components which had not been directed into secure positions within the well casing.

In order to be securely maintained within the casing, the slip member must be formed of segments which are evenly spaced radially within the casing and secured forcibly therein, to be maintained in a secure position by the gripping action of a plurality of sharp circumferential wickers on the exterior of the slip.

There is usually a plurality of wickers on a slip, and as the segments of the slip are moved radially outwardly toward the wall of the casing by a longitudinal force upon the slip, the wickers are made to bite into the wall of the casing.

Normally, a slip is designed as a short cylindrical component having a tapered interior and wickers symmetrically placed around the exterior.

As a result, I have seen many instances in which a slip member would fracture improperly or become unevenly distributed circumferentially within the casing, to cause improper security of the bridge plug within the casing.

The ideal situation is to have the slip segments evenly spaced radially so that the bridge plug will be secure to assure that plugging or sealing operations may be performed efficiently.

I believe the bridge plug which I have invented, particularly the operating components which cooperate to form the plugging action, eliminate the difficulties I have just expressed.

I have designed my invention to significantly increase the capability of slip components to fracture into equal segments and become distributed radially in an even manner toward the wall of the casing and thus provide for even distribution of all the forces which are placed upon the bridge plug and well bore. The probability of having the bridge plug fail is greatly reduced, and, as a consequent, much time and expense is saved in operation of the well.

To achieve these results I have designed a slip component which cooperates with a slip divider component in receiving longitudinal force from the slip divider in a manner for the slip to be fractured into equal segments, distributed radially equally within the casing, and which segments are made to grip the wall of the casing evenly and thus provide for equal distribution of forces upon the bridge plug.

The cooperation of the slip divider and slip is further enhanced by interlocking the slip divider and slip so that the two components are made to rotate radially together during any setting operation. Also, the interlocking of the slip divider and slip guides fractured segments of the slip uniformly radially during the setting or anchoring process. The bridge plug is successful for its intended purpose.

I have designed the slip dividers and slip components of my invention to operate with great simplicity, most importantly by constituting only two components which are easily and quickly placed in an operating condition, and thus are easy to manipulate, I have accomplished the efficient cooperation of the slip divider and slip by forming the slip with narrow longitudinal slots to permit the slip to fracture easily and positively under compressive force, and by forming both the slip divider and slip with cooperative toothed ends which assure smooth secure radial movement of the slip when necessary and which provide uniform movement of the fractured slip segments during the setting or anchoring process.

I have shown my slip divider and slip components in the specification as they may be incorporated with a simple, well-known form of well tool for clarity and easy understanding of my invention.

DESCRIPTION OF THE PREFERRED EMBODIMENTS

Figure 1:
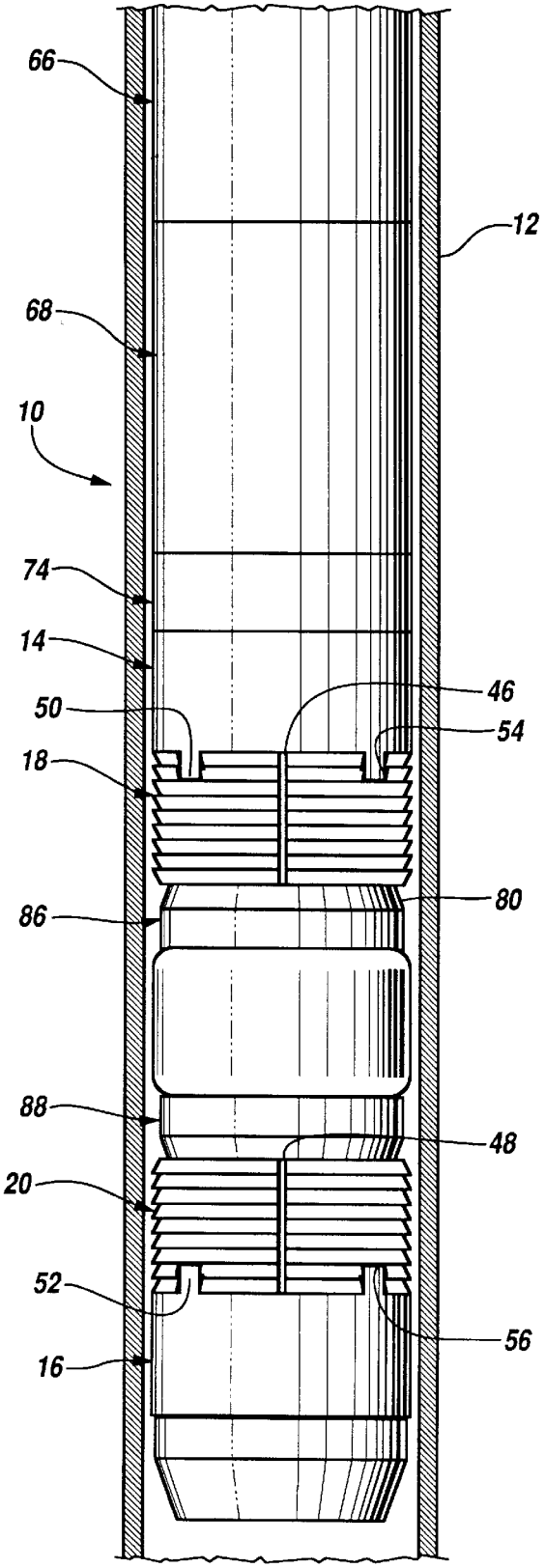
FIG. 1 is an elevational view of a bridge plug device showing slip divider and slip members according to my invention as the bridge plug would be placed in a typical well casing.

FIG. 1 describes a form of bridge plug 10, generally, as it would normally be placed within a well casing 12. The bridge plug includes means for positioning and securing a sealing element in a well casing 12 to prevent the escape of gas or fluid from a well.

For illustrative purposes I show slip dividers 14 and 16, generally, and slips 18 and 20, generally, in what I consider a conventional form of bridge plug. The bridge plug 10 includes components which set or anchor equipment in place in a well bore typically used to plug an oil, gas, water, or other type of well which is drilled into the earth.

The bridge plug is intended to seal the well bore to prevent pressurized gas or fluid from flowing across the plug.

Usually the bridge plug includes a compressible seal element which is compressed into a sealing condition and securing in this condition by the securing action of a slip component designed to fracture in response to the compressing action of the bridge plug, with the slip having means for being held securely within the well bore at the chosen location.

Figure 2:
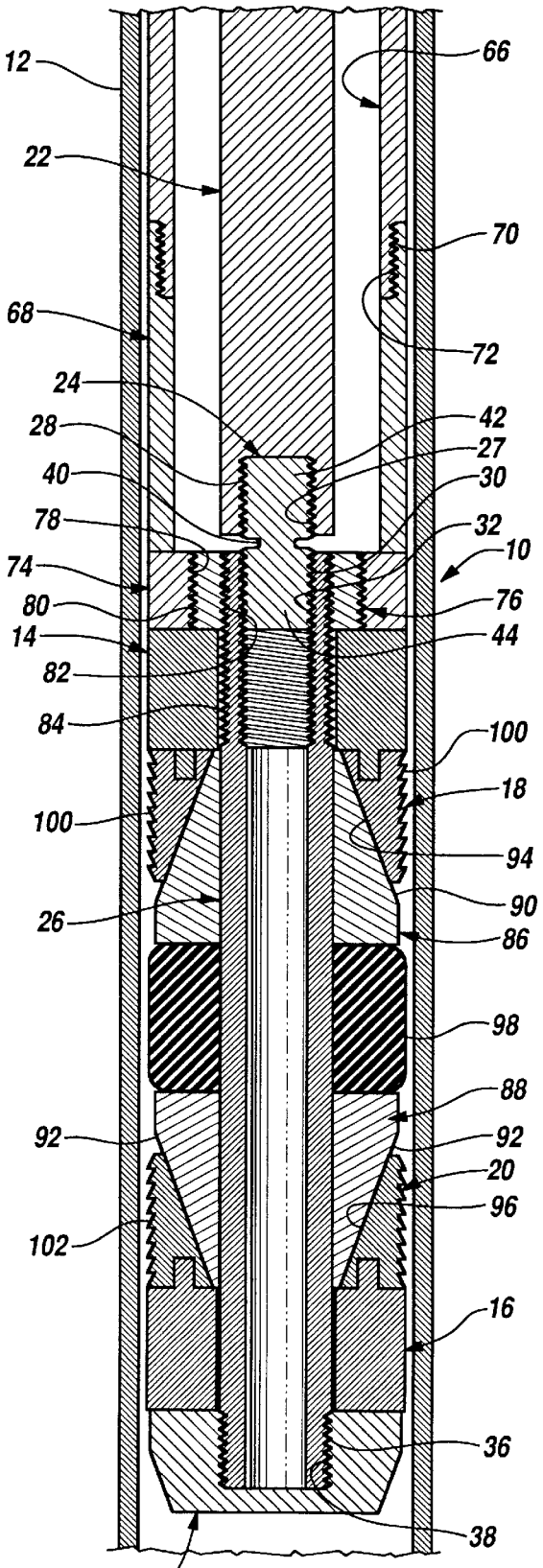
FIG. 2 is a cross sectional view of a bridge plug device showing slip divider and slip members in cooperative position.
Figure 3:
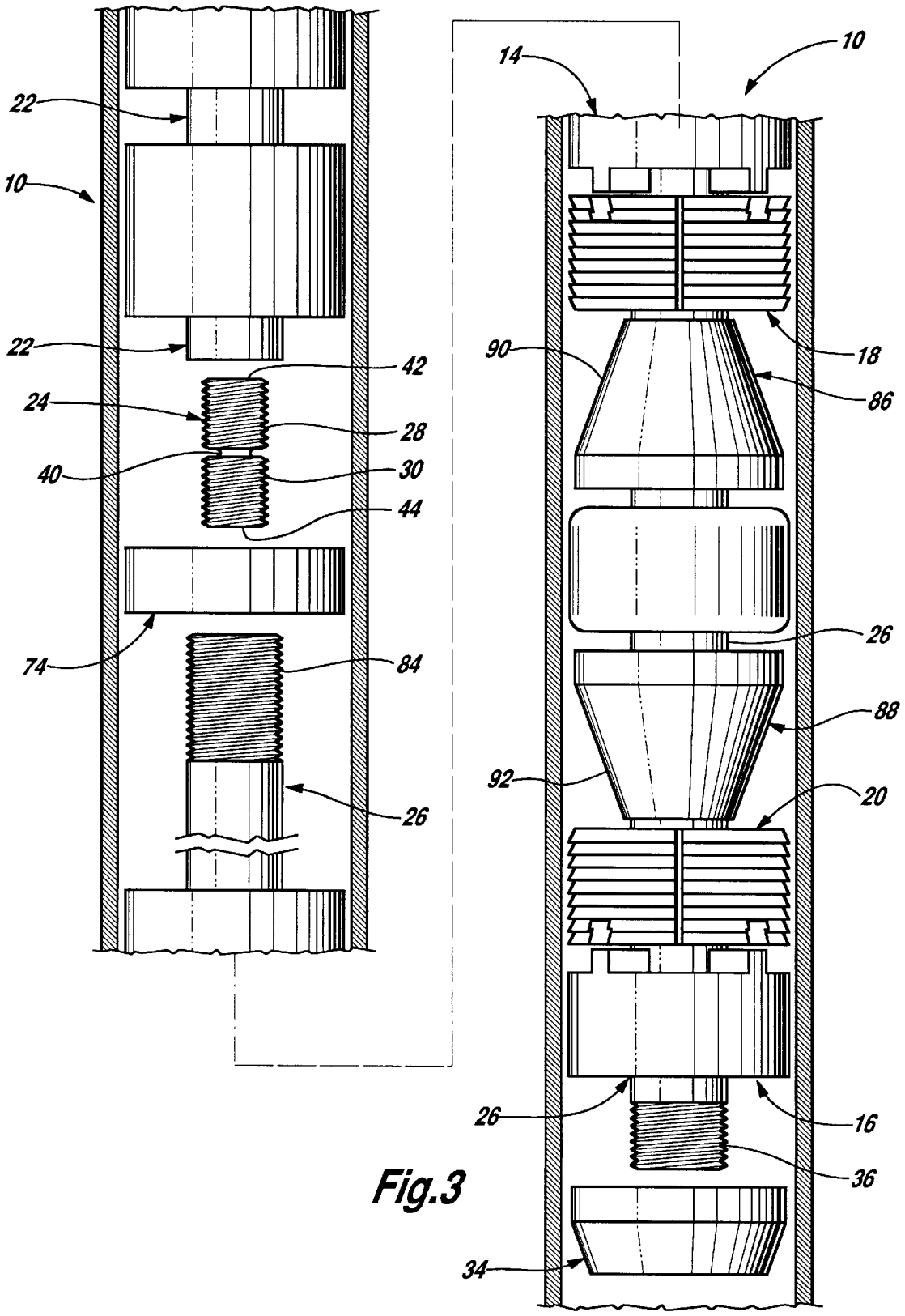
FIG. 3 is an exploded view of a bridge plug incorporating slip dividers and slips according to my invention to better illustrate the cooperative position of the components.

FIGS. 1, 2, and 3 describe the components of bridge plug 10 which cooperate to transmit a longitudinal force upon slip dividers 14 and 16 to cause slips 18 and 20 to fracture into equal segments radially outwardly which are forced securely against an inner wall of casing 12.

Initially, the sealing components of the bridge plug are held in a stationary position within the well bore by attachment to a rod-like member 22 of a suitable series of rod-like members, for positioning the slip dividers 14 and 16 and slips 18 and 20 at the chosen position within the bore.

Rod-like member 22 is held in stationary position within the well bore by attachment to a surface device (not shown).

At the lower end of rod-like member 22 a parting stud 24, generally, threadably connects rod-like member 22 to a mandrel 26, generally, by means of threads 27 within the lower end of rod-like member 22, threads 28 and 30 on stud 24, and threads 32 in mandrel 26.

Mandrel 26 has a supporting guide member 34 connected to the mandrel by means of threads 36 on mandrel 26 and threads 38 in the guide member 34.

Parting stud 24 includes an under cut 40 which is designed to fracture at a pre-determined fracturing value so that the parting stud 24 will separate into an upper portion 42 and a lower portion 44 by means of a downward force applied to a slidable component which transmits force from the surface to act upon the mandrel.

Figure 5:
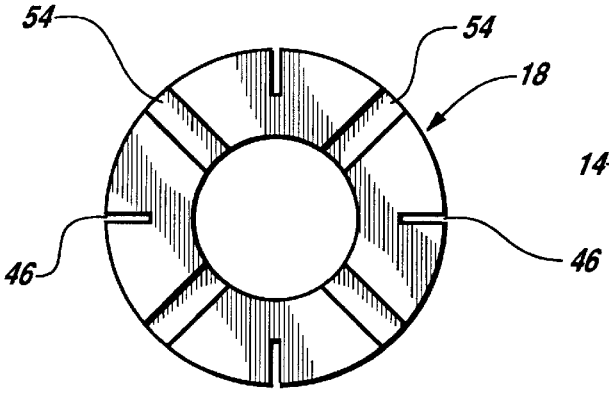
FIG. 5 is an end view of the slip shown in FIG. 4, displaying a series of grooves in one end and illustrating a series of longitudinal slots which act as fracture points.
Figure 6:
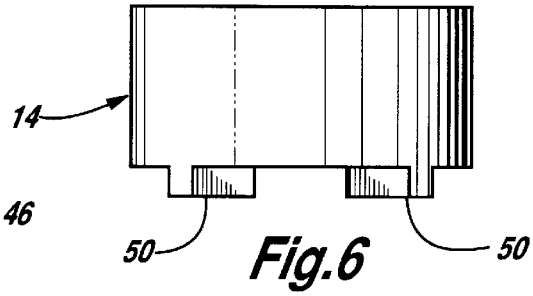
FIG. 6 is an elevational view of one form of slip divider according to my invention having cooperating prongs in one end for cooperation with grooves of the form of slip shown in FIG. 4.
Figure 4:
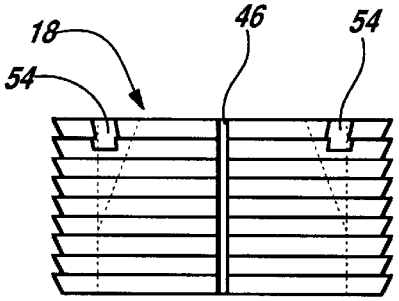
FIG. 4 is an elevational view of one form of slip according to my invention having cooperating grooves in one end for cooperation with prongs in a slip divider.
Figure 7:
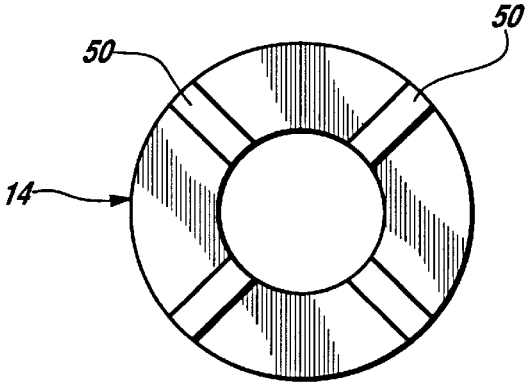
FIG. 7 is an end view of the slip divider shown in FIG. 6 displaying a series of prongs in one end which cooperate with grooves shown in the slip of FIG. 4.
Figure 8:
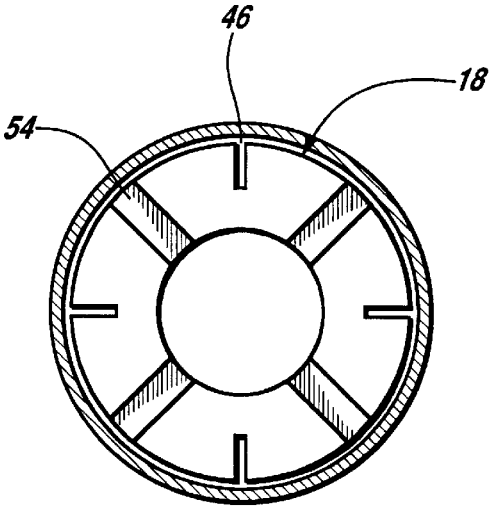
FIG. 8 is an end view of a slip according to my invention as it would appear in a well casing prior to fracturing, and displaying a typical space between the slip and the wall of the casing.
Figure 9:
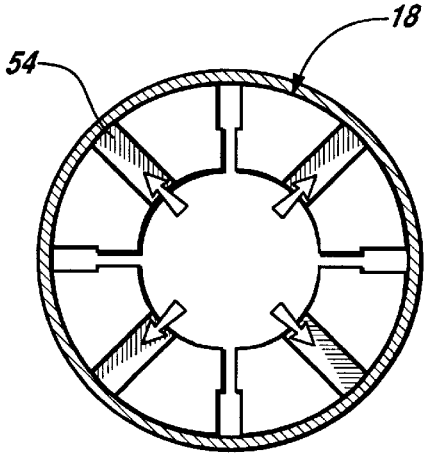
FIG. 9 is an end view of the slip shown in FIG. 8 as it would appear in a well casing after being fractured and displaying the manner in which the fractured segments are moved equally against the well casing.
Figure 10:
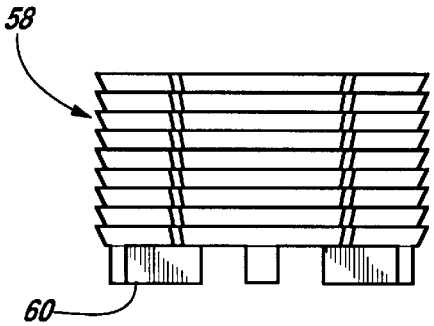
FIG. 10 is an elevational view of a second form of slip according to my invention having cooperating prongs in one end for cooperation with grooves in a slip divider.
Figure 13:
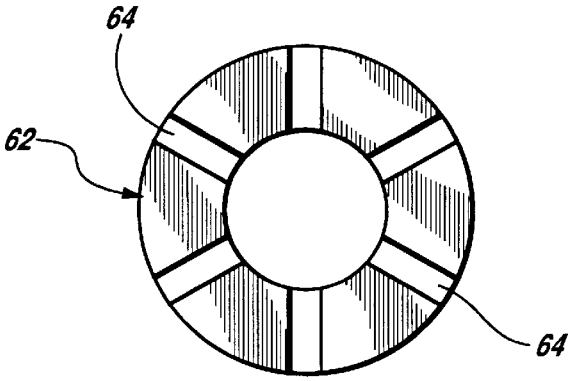
Figure 11:
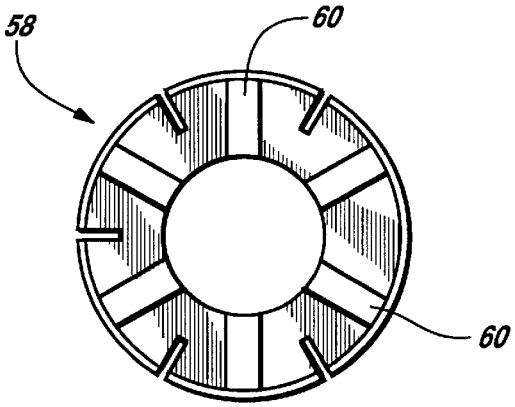
FIG. 11 is an end view of the slip shown in FIG. 10, displaying a series of prongs in one end.
Figure 12:
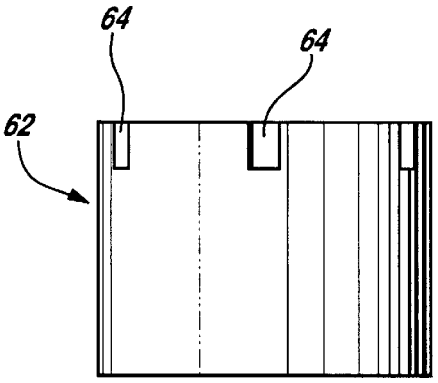
FIG. 12 is an elevational view of a second form of slip divider according to my invention having cooperating grooves in one end for cooperation with prongs of the form of slip shown in FIG. 10.

I describe the structure of a slip divider 14 and a slip 18 in FIGS. 5 thru 7 and show the plan of movement of the slip and slip segments in FIGS. 8 and 9.

I am able, if I feel it advantageous, to widen and/or deepen the toothed portions of the slip divider and grooved portions of the slips to an extent in which each cooperating portion may be referred to as a toothed portion.

Because the slips 18 and 20 are designed with longitudinal fracture cuts 46 and 48 spaced equally circumferentially around each slip, each fracture cut has the same anticipated value, and the longitudinal force will fracture each flip into segments of substantially equal size.

The slip dividers 14 and 16 have toothed portions 50 and 52 which cooperate closely with grooved portions 54 and 56 on slips 18 and 20. The cooperation of the toothed portions of the slip dividers with the grooved portions of the slips assure that the force placed upon the slips will be equally distributed upon the slips and that the slip segments are guided equally toward the inner wall of the casing as I show in FIG. 9.

Also, as I show in FIGS. 10 thru 13, I may provide altered forms of slip dividers and slips in which the toothed portions may be designed on slip 58, generally, as toothed portions 60, and slip divider 62, generally, as having grooved portions 64.

For operable assembly, the bridge plug 10, is positioned at the lower end of a series of rod-like members 22 extending a required depth in the well bore and held stationarily therein.

A cylinder 66 receives the longitudinal force from the surface and is slidable around rod-like members 22 and mandrel 26. Cylinder 66 has a setting sleeve 68 attached by threads 70 and 72. Cylinder 66 is placed to move against a cap 74, generally, which is attached to a locking ring 76, generally, held within cap 74 by threads 78 in cap 74 and threads 80 on locking ring 76. Locking ring 76 is attached to the mandrel 26 by inner threads 82 on locking ring 76 and threads 84 on mandrel 26. The locking ring 76 is configured such that the force used to set the bridge plug is locked into place.

Upon actuation of the bridge plug, the rod-like members 22 and the mandrel 26 are held stationarily and cylinder 66 and setting sleeve 68 are forced downwardly, causing the setting sleeve 68 to urge the cap 74, locking ring 76, slip divider 14, and slip 18 downwardly toward guide 34.

The forcible movement causes cone members 86 and 88, generally, to move slidably within slips 18 and 20 by forcing tapered surfaces 90 and 92 on cones 86 and 88, respectively, to move against tapered surfaces 94 and 96 of slips 18 and 20, respectively.

This same longitudinal force causes cones 86 and 88 to compress elastomeric seal 98 between the cones, and the compression of seal element 98 seals the casing 12.

The same continuing longitudinal force that fractures slips 18 and 20 into fractured segments causes a series of wickers 100 and 102 on each slip segment to dig into the inner wall of the casing 12, securing the position of the bridge plug within the casing 12.

As I have described, the configuration of the slip dividers and slips of my invention provide an even initial force upon the slips and equal distribution of each slip segment against the inner wall of the casing.

Since many different embodiments of my invention may be made without departing from the spirit and scope thereof, it is to be understood that the specific embodiments I have described in detail herein are not to be taken in a limiting sense, since the scope of my invention is best defined by the appended claims.

I claim:

1. A bridge plug positionable within a casing and adaptable for sealing said casing, comprising:

a cylindrical component placed within said casing, said cylindrical component secured to a means for actuating the bridge plug, and movable in response to said actuating means, a rod-like component lowered within said cylindrical component, said rod-like component held stationarily within said cylindrical component by a securing member outside said cylindrical component, a mandrel secured to a lower end of said rod-like component, a guide member secured to a lower end of said mandrel, said guide member providing a resistance force against said means for actuating the bridge plug a slip divider component positioned movably upon said mandrel, said slip divider component responsive to action of said cylindrical component, and said slip divider component having a toothed end including at least two tooth members, a slip member positioned movably upon said mandrel adjacent said slip divider component, including a toothed end having at least two tooth members, said toothed end cooperable with said toothed end of said slip divider component, a longitudinal fracture cut, an internal taper, and means for securing said bridge plug in said casing upon actuation of said bridge plug, a cone member positioned movably on said mandrel adjacent said slip member, including an external taper of substantially a same taper as said taper of said slip member to provide a means for applying a fracturing force to said slip member upon actuation of said bridge plug, said cone member responsive to said resistance force to transmit said resistance force to said slip member to assist in a fracturing of said slip member, and a seal element adjacent said cone member, compressible by counteraction of said resistance force and said means for actuating the bridge plug.

2. A bridge plug as described in claim 1, wherein:

said slip member includes at least two longitudinal fracture cuts along a surface thereof which comprise places of fracture of said slip member in response to said means for actuating said bridge plug.

3. A bridge plug as described in claim 2, wherein:

said longitudinal fracture cuts are positioned along an external surface of said slip.

4. A bridge plug as described in claim 3, wherein:

said slip divider component includes a first slip divider and a second slip divider, said slip member includes a first slip and a second slip, said cone member includes a first cone and a second cone, said first slip is adjacent said first slip divider, said first cone is adjacent said first slip and said seal element, said second cone is oppositely disposed of said seal element from said first cone and is adjacent said seal element and said second slip, and said second slip is adjacent said second cone and said second slip divider.

5. A bridge plug as described in claim 4, wherein:

said toothed ends of said first and second slip dividers comprise rectangular tooth members, and said toothed ends of said first and second slips comprise rectangular tooth members.

6. A bridge plug as described in claim 5, wherein:

said first and second slips include angularly positioned circumferential wicker members, said wicker members being angularly disposed toward said seal element.

7. A bridge plug as described in claim 2, wherein:

said longitudinal fracture cuts are positioned along an internal surface of said slip.

8. A bridge plug as described in claim 7, wherein:

said slip divider component includes a first slip divider and a second slip divider, said slip member includes a first slip and a second slip, said cone member includes a first cone and a second cone, said first slip is adjacent said first slip divider, said first cone is adjacent said first slip and said seal element, said second cone is oppositely disposed of said seal element from said first cone and is adjacent said seal element and said second slip, and said second slip is adjacent said second cone and said second slip divider.

9. A bridge plug as described in claim 8, wherein:

said toothed ends of said first and second slip dividers comprise rectangular tooth members, and said toothed ends of said first and second slips comprise rectangular tooth members.

10. A bridge plug as described in claim 9, wherein:

said first and second slips include angularly positioned circumferential wicker members, said wicker members being angularly disposed toward said seal element.

11. A bridge plug positionable within a casing and adaptable for sealing said casing, comprising:

a cylindrical component placed within said casing, said cylindrical component secured to a means for actuating the bridge plug, and movable in response to said actuating means, a rod-like component lowered within said cylindrical component, said rod-like component held stationarily within said cylindrical component by a securing member outside said cylindrical component, a mandrel secured to a lower end of said rod-like component, a guide member secured to a lower end of said mandrel, said guide member providing a resistance force against said means for actuating the bridge plug, said cylindrical component including a slip divider component at one end thereof, said slip divider component having a toothed end including at least two tooth members, a slip member positioned movably upon said mandrel adjacent said slip divider component, including a toothed end including at least two tooth members, said toothed end cooperable with said toothed end of said slip divider component, and an internal taper, and means for securing said bridge plug in said casing actuation of said bridge plug, a cone member positioned movably on said mandrel adjacent said slip member, including an external taper of substantially a same taper as said taper of said slip member to provide a means for applying a fracturing force to said slip member upon actuation of said bridge plug, said cone member responsive to said resistance force to transmit said resistance force to said slip member to assist in a fracturing of said slip member, and a seal element adjacent said cone member, compressible by counteraction of said resistance force and said means for actuating the bridge plug.

12. A bridge plug as described in claim 11, wherein:

said slip member includes at least two longitudinal fracture cuts along a surface thereof which comprise places of fracture of said slip member in response to said means for actuating said bridge plug.

13. A bridge plug as described in claim 14, wherein:

said longitudinal fracture cuts are positioned along an external surface of said slip member.

14. A bridge plug as described in claim 13, wherein:

said slip divider component includes a first slip divider and a second slip divider, said slip member includes a first slip and a second slip, said cone member includes a first cone and a second cone, said first slip is adjacent said first slip divider, said first cone is adjacent said first slip and said seal element, said second cone is oppositely disposed of said seal element from said first cone and is adjacent said seal element and said second slip, and said second slip is adjacent said second cone and said slip divider.

15. A bridge plug as described in claim 14, wherein:

said toothed ends of said first and second slip dividers comprise rectangular tooth members, and said toothed ends of said first and second slips comprise rectangular tooth members.

16. A bridge plug as described in claim 15, wherein:

said first and second slips include angularly positioned circumferential wicker members, said wicker members being angularly disposed toward said seal element.

17. A bridge plug as described in claim 12, wherein:

said longitudinal fracture cuts are positioned along an internal surface of said slip.

18. A bridge plug as described in claim 17, wherein:

said slip divider component includes a first slip divider and a second slip divider, said slip member includes a first slip and a second slip, said cone member includes a first cone and a second cone, said first slip is adjacent said first slip divider, said first cone is adjacent said first slip and said seal element, said second cone is oppositely disposed of said seal element from said first cone and is adjacent said seal element and said second slip, and said second slip is adjacent said second cone and said second slip divider.

19. A bridge plug as described in claim 18, wherein:

said toothed ends of said first and second slip dividers comprise rectangular tooth members, and said toothed ends of said first and second slips comprise rectangular tooth members.

20. A bridge plug as described in claim 19, wherein:

said first and second slips include angularly positioned circumferential wicker members, said wicker members being angularly disposed toward said seal element.

21. A bridge plug positionable within a casing and adaptable for sealing said casing, comprising:

a cylindrical component placed within said casing, said cylindrical component secured to a means for actuating the bridge plug, and movable in response to said actuating means, a rod-like component lowered within said cylindrical component, said rod-like component held stationarily within said cylindrical component by a security member outside said cylindrical component, a mandrel secured to a lower end of said rod-like component, a guide member secured to a lower end of said mandrel, said guide member providing a resistance force against said means for actuating the bridge plug, a slip divider component positioned upon said mandrel, said slip divider component responsive to action of said cylindrical component, and said slip divider component having a toothed end including at least two tooth members, said guide member includes a slip member, said slip member including a toothed end including at least two tooth members, said toothed end cooperable with said toothed end of said slip divider component, a tapered structure, and means for securing said bridge plug in said casing upon actuation of said bridge plug, a cone member positioned movably on said mandrel adjacent said slip member, including a tapered structure of substantially a same taper as said taper of said slip member to provide a means for applying a fracturing force to said slip member upon actuation of said bridge plug, said cone member responsive to said resistance force to transmit said resistance force to said slip member to assist in a fracturing of said slip member, and a seal element adjacent said cone member, compressible by counteraction of said resistance force and said means for actuating the bridge plug.

22. A bridge plug as described in claim 21, wherein:

said slip member includes at least two longitudinal fracture cuts along a surface thereof which comprise places of fracture of said slip member in response to said means for actuating said bridge plug.

23. A bridge plug as described in claim 22, wherein:

said longitudinal fracture cuts are positioned along an external surface of said slip member.

24. A bridge plug as described in claim 23, wherein:

said slip divider component includes a first slip divider and a second slip divider, said slip member includes a first slip and a second slip, said cone member includes a first cone and a second cone, said first slip is adjacent said first slip divider, said first cone is adjacent said first slip and said seal element, said second cone is oppositely disposed of said seal element from said first cone and is adjacent said seal and said second slip, and said second slip is adjacent said second cone and said second slip divider.

25. A bridge plug as described in claim 24, wherein:

said toothed ends of said first and second slip dividers comprise rectangular tooth members, and said toothed ends of said first and second slips comprise rectangular tooth members.

26. A bridge plug as described in claim 25, wherein:

said first and second slips include angularly positioned circumferential wicker members, said wicker members being angularly disposed toward said seal element.

27. A bridge plug as described in claim 22, wherein:

said longitudinal fracture cuts are positioned along an internal surface of said slip.

28. A bridge plug as described in claim 27, wherein:

said slip divider component includes a first slip divider and a second slip divider, said slip member includes a first slip and a second slip, said cone member includes a first cone and a second cone, said first slip is adjacent said first slip divider, said first cone is adjacent said first slip and said seal element, said second cone is oppositely disposed of said seal element from said first cone and is adjacent said seal element and said second slip, and said second slip is adjacent said second cone and said second slip divider.

29. A bridge plug as described in claim 28, wherein:

said toothed ends of said first and second slip dividers comprise rectangular tooth members, and said toothed ends of said first and second slip comprise rectangular tooth members.

30. A bridge plug as described in claim 29, wherein:

said first and second slips include angularly positioned circumferential wicker members, said wicker members being angularly disposed toward said seal element.

31. A bridge plug as described in claim 21, wherein:

said cylindrical component includes said slip divider component at one end thereof.

* * * * *